US009977384B2

(12) United States Patent
Ito et al.

(10) Patent No.: US 9,977,384 B2
(45) Date of Patent: May 22, 2018

(54) IMAGE FORMING APPARATUS INCLUDING SCANNER UNIT DISPOSED ABOVE SHEET EJECTION TRAY

(71) Applicant: Brother Kogyo Kabushiki Kaisha, Nagoya-shi, Aichi-ken (JP)

(72) Inventors: Sakae Ito, Kitanagoya (JP); Kota Fujii, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/417,263

(22) Filed: Jan. 27, 2017

(65) Prior Publication Data

US 2017/0219976 A1 Aug. 3, 2017

(30) Foreign Application Priority Data

Jan. 29, 2016 (JP) ..... 2016-016179

(51) Int. Cl.
*G03G 15/00* (2006.01)

(52) U.S. Cl.
CPC ..... *G03G 15/502* (2013.01); *G03G 15/5016* (2013.01)

(58) Field of Classification Search
CPC ..... G03G 15/502; G03G 15/5016
USPC ..... 399/81
See application file for complete search history.

(56) References Cited

U.S. PATENT DOCUMENTS

2005/0175371 A1* 8/2005 Kunugi ..... G03G 15/5016 399/107
2006/0230689 A1* 10/2006 Asakawa ..... G03G 15/5016 52/32
2007/0007113 A1* 1/2007 Watanabe ..... G03G 15/5016 200/5 A

FOREIGN PATENT DOCUMENTS

JP 2004112832 A 4/2004
JP 2010134356 A * 6/2010
JP 2013038690 A 2/2013
JP 2013228554 A 11/2013
JP 2015068994 A 4/2015

* cited by examiner

*Primary Examiner* — Billy Lactaoen
(74) *Attorney, Agent, or Firm* — Banner & Witcoff, Ltd.

(57) ABSTRACT

An image forming apparatus includes a printer unit including a sheet ejection tray located on an upper surface of the printer unit; a scanner unit spaced above the sheet ejection tray of the printer unit in a vertical direction; an operation unit disposed at a front end portion of the scanner unit, the operation unit including a touchscreen; a cover covering a bottom side of the touchscreen in the vertical direction; and a fixing portion fixing the cover to the front end portion of the scanner unit. The cover includes a support portion that, when projected on an imaginary horizontal surface, overlaps a part of the touchscreen. The support portion is shaped like a box extending in the vertical direction and is coupled to a portion of the upper surface of the printer unit adjacent to the sheet ejection tray.

20 Claims, 12 Drawing Sheets

IMAGE FORMING APPARATUS INCLUDING SCANNER UNIT DISPOSED ABOVE SHEET EJECTION TRAY

CROSS-REFERENCE TO RELATED APPLICATION

This application claims priority from Japanese Patent Application No. 2016-016179 filed on Jan. 29, 2016, the content of which is incorporated herein by reference in its entirety.

FIELD OF DISCLOSURE

Aspects disclosed herein relate to an image forming apparatus including a sheet ejection tray and a scanner unit disposed above the sheet ejection tray in a vertical direction.

BACKGROUND

A known image forming apparatus includes a printer unit, a scanner unit disposed above the printer unit, and an operation panel. The operation panel is disposed at a front portion of the scanner unit and above a space for ejecting sheets from the printer unit. The operation unit includes a touchscreen. The touchscreen is provided in a central portion of the operation panel relative to a width of the operation panel.

The space for ejecting sheets refers to a space for placing sheets having images formed thereon. The space is provided between the printer unit and the scanner unit and defined by a sheet ejection tray and a bottom surface of the scanner unit. The touchscreen is a kind of operation device that accepts input from a user, who touches or presses a specified area displayed on the touchscreen.

SUMMARY

An input device including movable portions such as push buttons may provide tactile feedback, e.g., a click, to users. However, some users fail to get tactile feedback from a touchscreen. Thus, to get the tactile feedback, some users may press a touchscreen with a great force compared with a case for pressing a push button.

According to an aspect of the disclosure, an image forming apparatus includes a printer unit configured to form an image on a sheet, a scanner unit spaced above the sheet ejection tray of the printer unit in a vertical direction, an operation unit, a cover and a fixing portion. The printer unit includes a sheet ejection tray. The sheet ejection tray is located on an upper surface of the printer unit and configured to receive the sheet ejected from the printer unit. The scanner unit includes a base portion. The base portion includes a document receiving portion configured to receive a document to be scanned. The operation unit is disposed at a front end portion of the scanner unit. The front end portion is located toward a downstream side of the sheet ejection tray in a sheet ejection direction in which the sheet is ejected from the printer unit toward the sheet ejection tray. The operation unit includes a touchscreen. The cover covers a bottom side of the touchscreen in the vertical direction. The fixing portion fixes the cover to the front end portion of the scanner unit. The cover includes a support portion that, when projected on an imaginary horizontal surface, overlaps a part of the touchscreen. The support portion is shaped like a box extending in the vertical direction and is coupled to a portion of the upper surface of the printer unit adjacent to the sheet ejection tray.

This configuration enables the support portion and the fixing portion to receive a downward load acting on the touchscreen via the cover.

The support portion, which is disposed below the touchscreen, helps reduce deformation at a portion of the operation unit including the touchscreen when the touchscreen is subjected to the downward load.

BRIEF DESCRIPTION OF THE DRAWINGS

Reference is made to the following description taken in connection with the accompanying drawings, like reference numerals being used for like corresponding parts in the various drawings.

DETAILED DESCRIPTION

An illustrative embodiment of the disclosure will be described with reference to the accompanying drawings. The following discussion will be made as to an image forming apparatus to which the present disclosure is applied. Arrows indicating directions in each drawing are indicated to facilitate the understanding of positional relationships among components.

For portions or components, which will be described with numerals, at least one is provided unless "plural" or "two or more" is specifically stated otherwise.

The following will describe a schematic configuration of an image forming apparatus 1. The image forming apparatus 1 has, for example, a copy function, a scanning function, and a print function.

Figure 1:
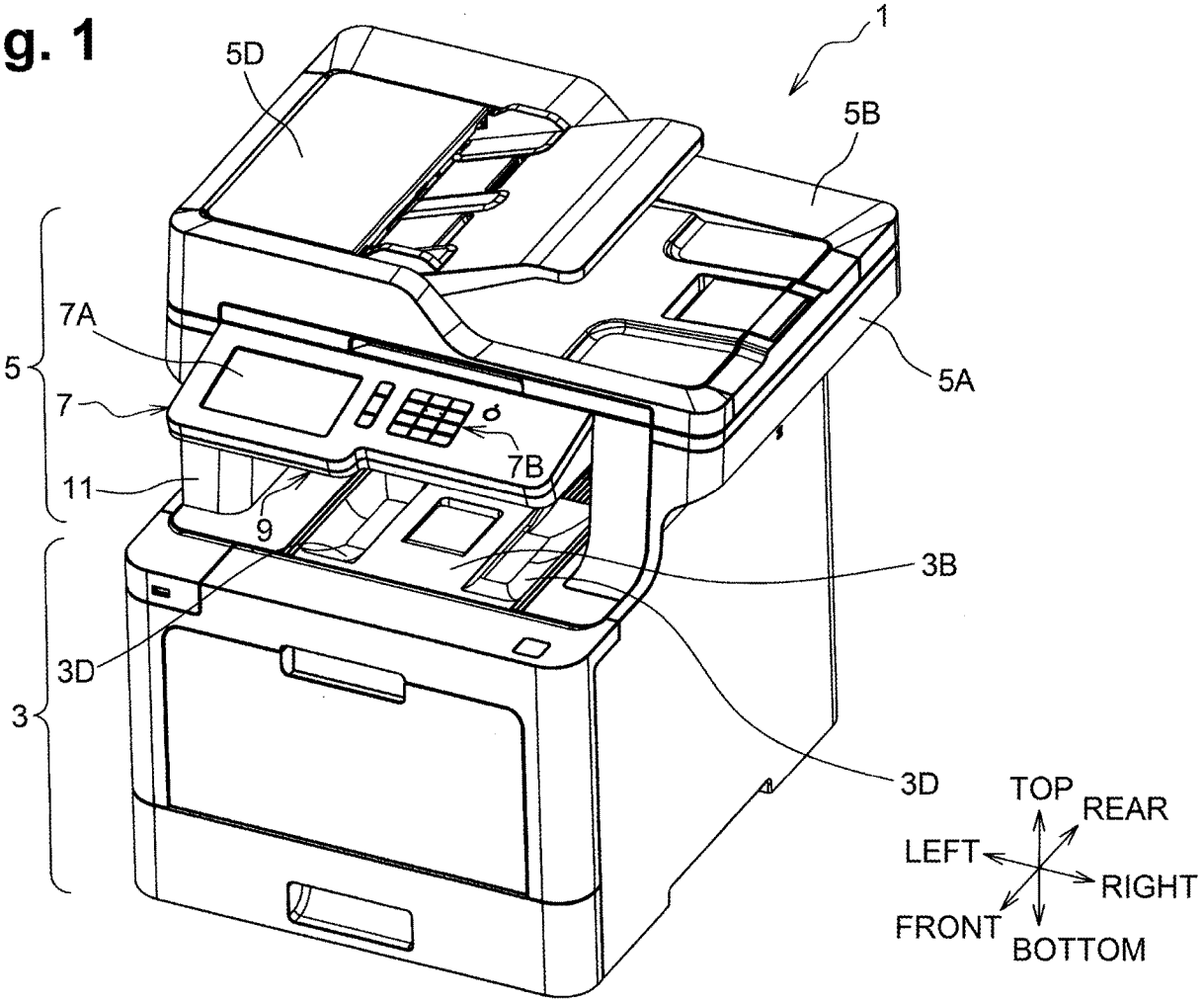
FIG. 1 is a perspective view of an image forming apparatus according to an aspect of the disclosure.
Figure 2:
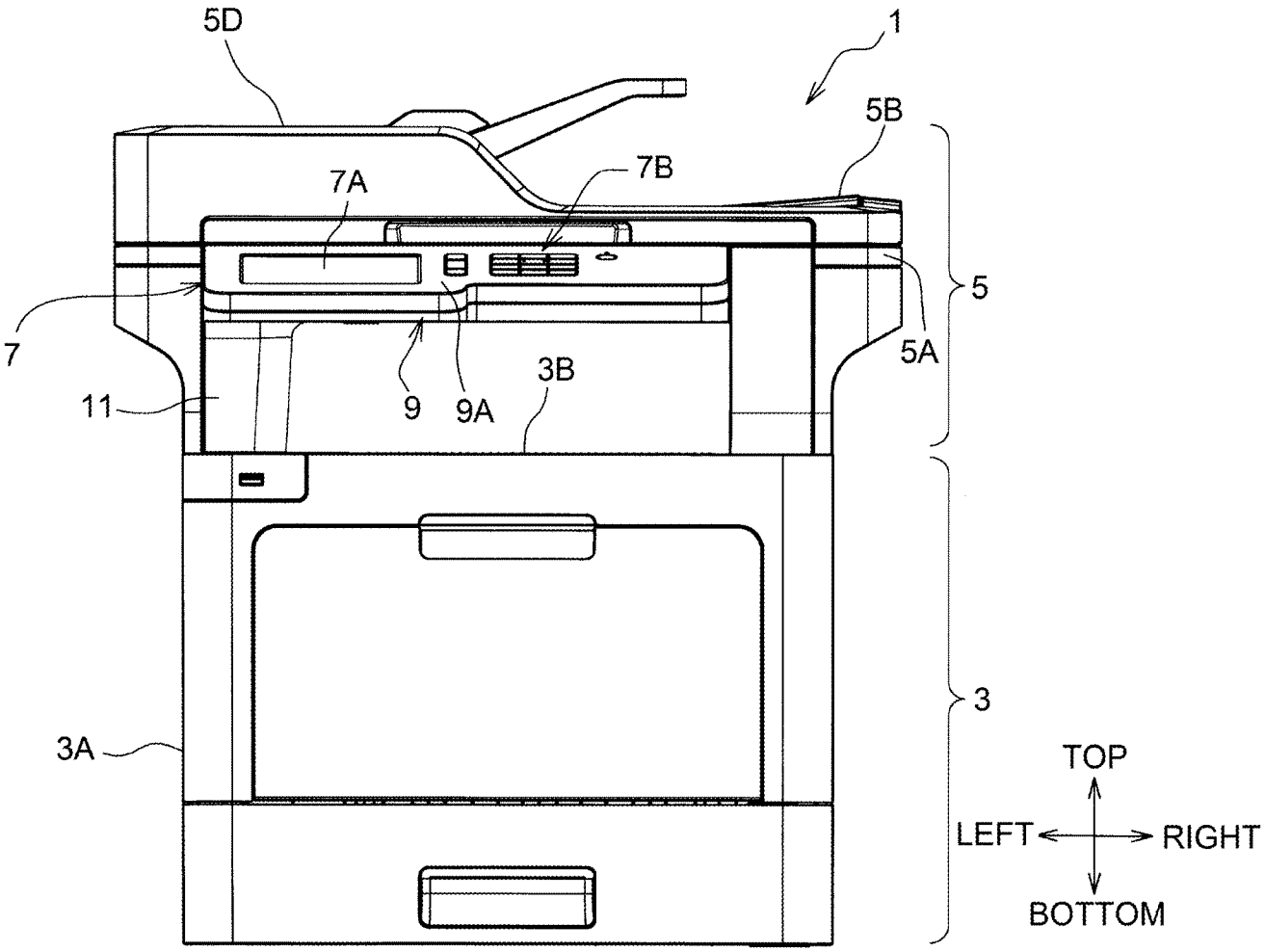
FIG. 2 is a front view of the image forming apparatus.

As illustrated in FIGS. 1 and 2, the image forming apparatus 1 includes a printer unit 3, a scanner unit 5 and an operation unit 7.

The printer unit 3 is configured to form or print an image on a sheet. The printer 3 includes a housing 3A, which accommodates inside an electrophotographic image forming unit (not illustrated). A sheet ejection tray 3B is formed on an upper surface of a casing 3A of the printer unit 3. The sheet ejection tray 3B receives a sheet having image thereon.

The scanner unit 5 is configured to scan an image of an object, such as a document. The scanner unit 5 is disposed above the printer unit 3. Specifically, as illustrated in FIG. 1, the scanner unit 5 is upwardly spaced apart from the sheet ejection tray 3B.

The sheet ejection tray 3B and the scanner unit 5 define, therebetween, a space 3C (FIG. 5) which is open toward the front side. The space 3C functions as a space available for stacking sheets ejected from the printer unit 3. A sheet having image formed thereon is ejected to the space 3C and stacked on the sheet ejection tray 3B.

The scanner unit 5 includes a base portion 5A and a document cover 5B. The base portion 5A includes a document receiving portion 5C (FIG. 3) which is configured to receive a document to be scanned. The document cover 5B covers the document receiving portion 5C in the vertical direction.

The document cover 5B is movable between a position (FIG. 1) where the document cover 5B covers the document receiving portion 5C in the vertical direction and a position where the document cover 5B leaves the document receiving portion 5C open. The document cover 5B of the embodiment has an automatic document feeder 5D.

Figure 3:
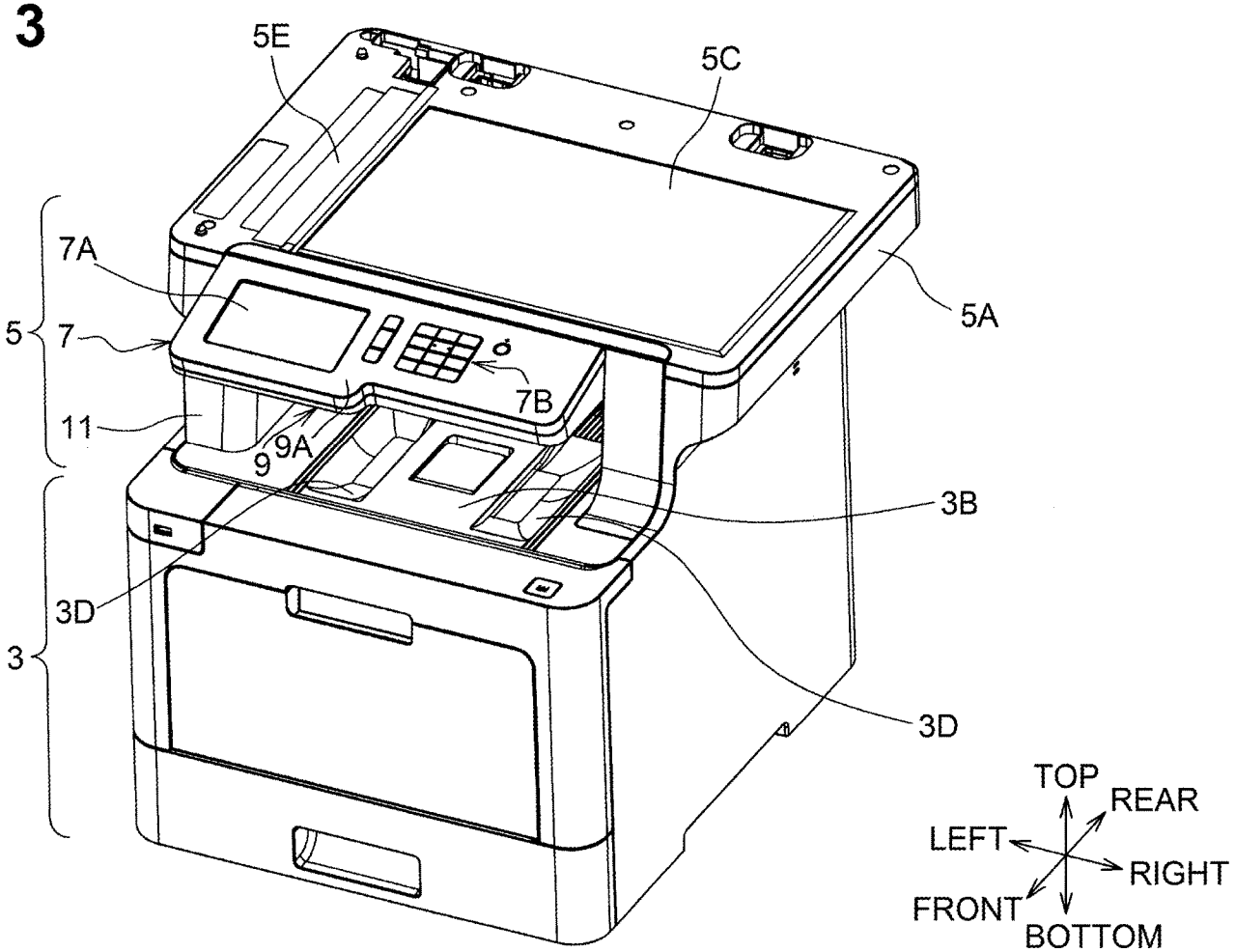
FIG. 3 is a perspective view of the image forming apparatus from which a document cover is removed.

The automatic document feeder 5D is configured to automatically feed documents one by one to an image reader 5E (FIG. 3). The image forming apparatus 1 is configured to copy by printing an image of a document scanned at the scanner unit 5 at the printer unit 3.

The operation unit 7 of the embodiment includes a touchscreen 7A and an input area 7B. The touchscreen 7A accepts input from a user, who touches or presses a specified area displayed on a liquid crystal display panel. The input area 7B accepts input from a user, who presses a movable portion such as a push button.

Figure 4:
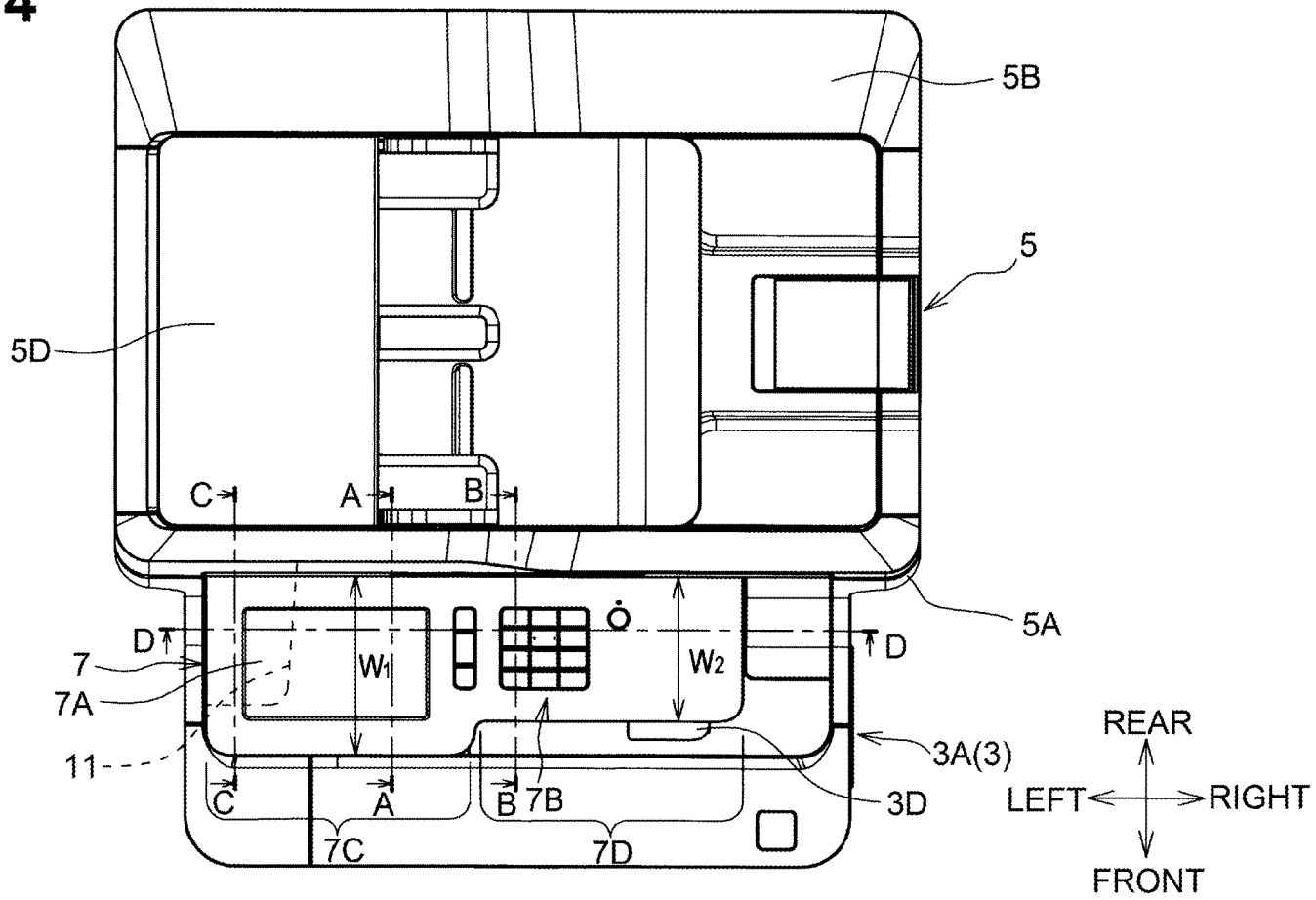
FIG. 4 is a top view of the image forming apparatus.

As illustrated in FIG. 4, the operation unit 7 is disposed at a front end portion of the scanner unit 5. "Front" refers to a downstream side in a sheet ejection direction in which a sheet is ejected from the printer unit 3 toward the sheet ejection tray 3B. In other words, a sheet ejected from the printer unit 3 toward the sheet ejection tray 3B is ejected toward the front portion of the image forming apparatus 1.

As illustrated in FIG. 2, the operation unit 7 of the embodiment is a panel-shaped section extending in a left-right direction at the front end portion of the scanner unit 5. The "left-right direction" refers to a sheet width direction orthogonal to the sheet ejection direction. The "sheet width direction" refers to a direction orthogonal to the sheet ejection direction and the thickness of a sheet.

The input area 7B is located at a position spaced from the touchscreen 7A in the left-right direction. Specifically, the touchscreen 7A is located proximate to a left end of the operation unit 7 in the left-right direction. The input area 7B is located to the right of the touchscreen 7A and in a central portion of the operation unit 7 in the left-right direction.

The following will describe structures of the operation unit 7 and immediate parts.

Figure 5:
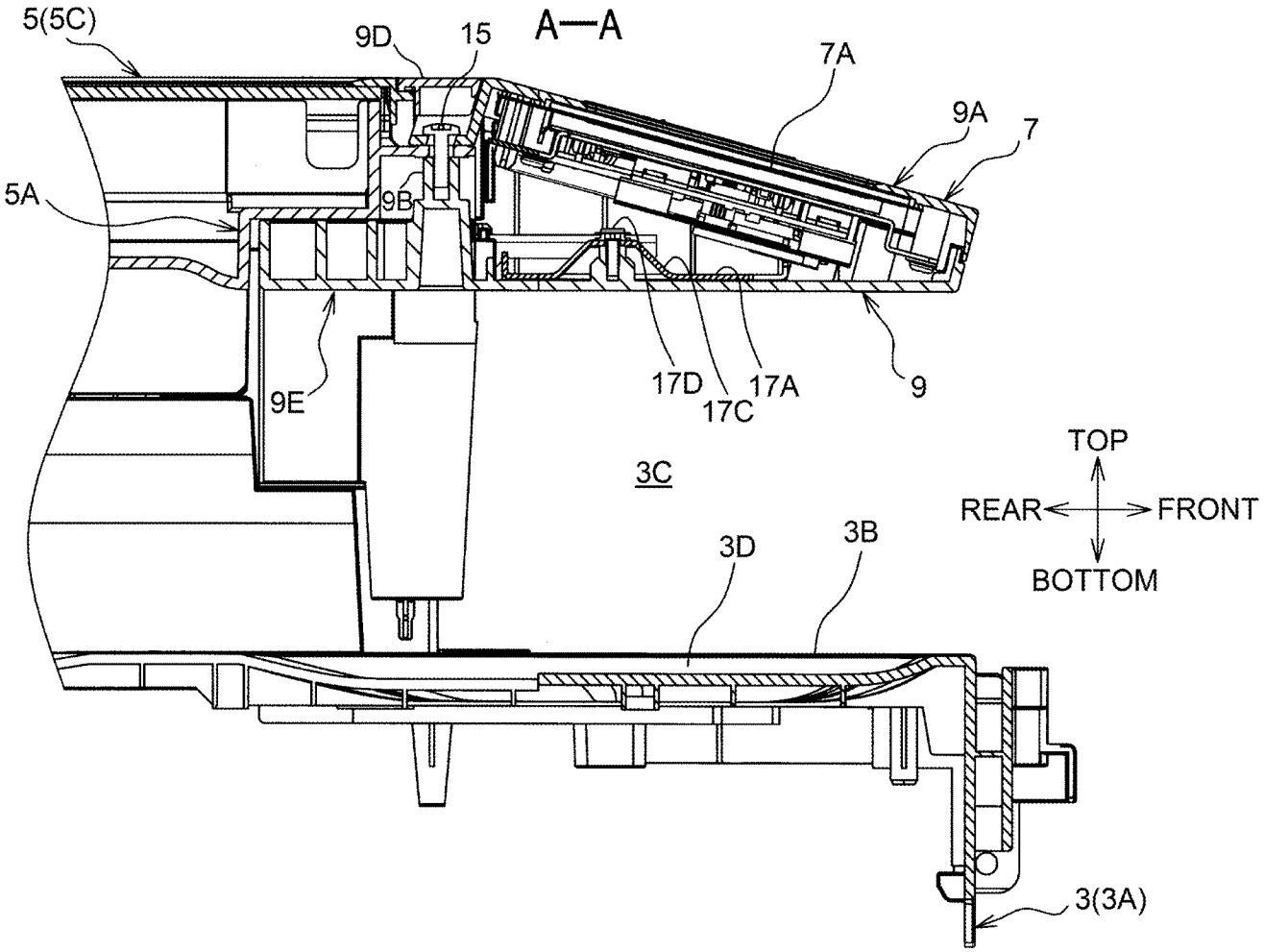
FIG. 5 is a cross sectional view taken along the line A-A of FIG. 4.
Figure 6:
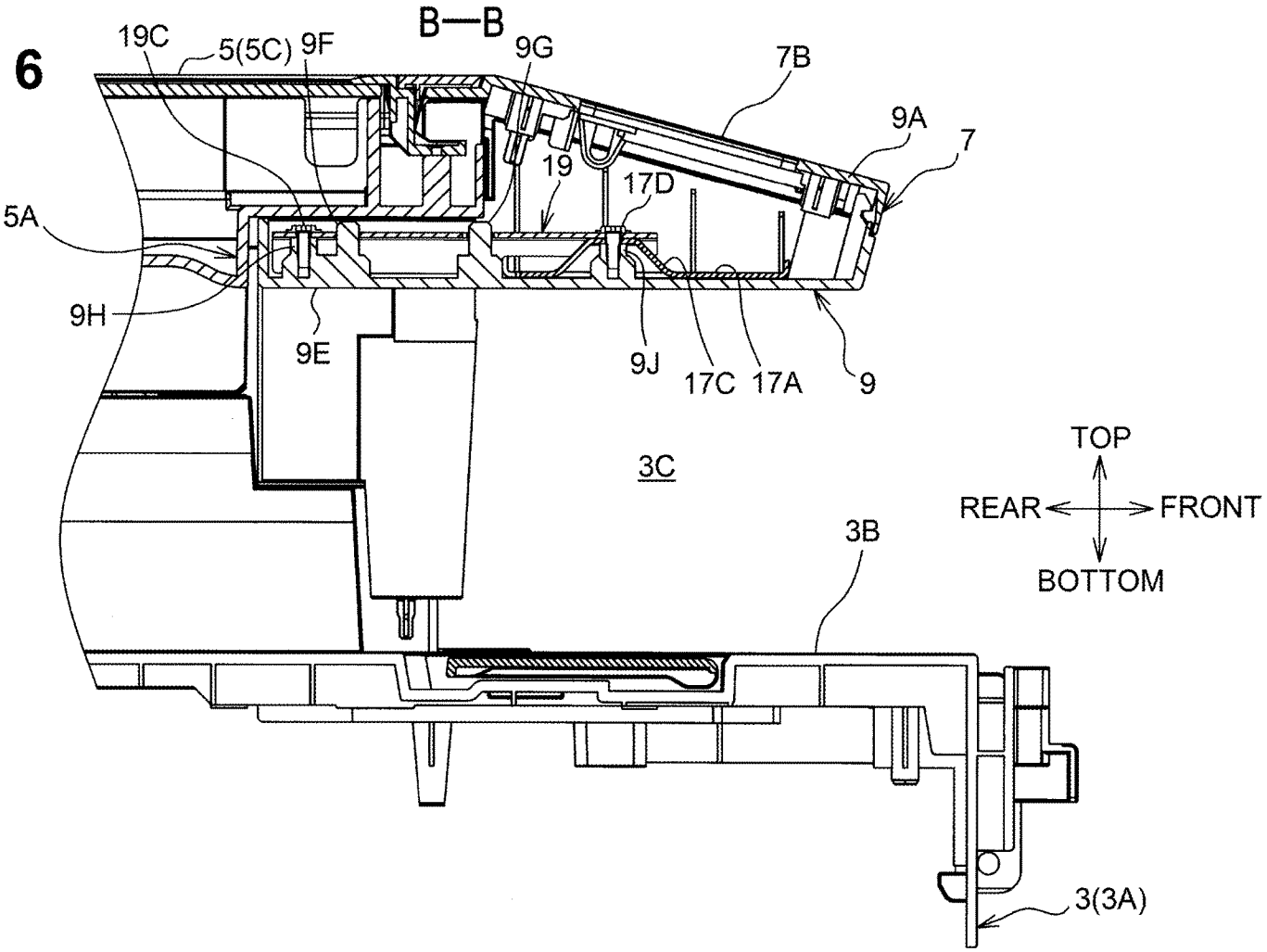
FIG. 6 is a cross sectional view taken along the line B-B of FIG. 4.

As illustrated in FIGS. 5 and 6, a lower cover 9, which is made of resin, of the operation unit 7 is disposed on a lower side or under the touchscreen 7A and the input area 7B in the vertical direction. The lower cover 9 covers the bottom sides of the touchscreen 7A and the input area 7B in the vertical direction and receives a downward load acting on the touchscreen 7A and the input area 7B.

The lower cover 9 of the embodiment is a resin-made single part which seamlessly connects a portion covering the bottom side of the touchscreen 7A and a portion covering the bottom side of the input area 7B.

An upper cover 9A is disposed on an upper side of the operation unit 7 in the vertical direction. The upper cover 9A provides an upper aesthetic surface of the operation unit 7. The upper cover 9A and the lower cover 9 define therebetween a space in which electric circuit boards for the touchscreen 7A and the input area 7B are accommodated.

As illustrated in FIGS. 1 and 2, the lower cover 9 includes a support portion 11. The support portion 11 is shaped like a box extending in the vertical direction and is coupled to a portion of the upper surface of the printer unit 3 adjacent to the sheet ejection tray 3B. The support portion 11 is configured to receive a downward load acting on the lower cover 9. The supporting portion 11 and the lower cover 9 are made of resin and constitute a one-piece assembly.

As illustrated in FIG. 4, when projected onto an imaginary horizontal surface, the support portion 11 overlaps a part of the touchscreen 7A. In other words, the "imaginary horizontal surface" corresponds to a drawing sheet surface of FIG. 4. The support portion 11 illustrated in FIG. 4 overlaps a part of the touchscreen 7A illustrated in FIG. 4.

A touchscreen-side front end portion 7C of the operation unit 7 is disposed further in a front direction than an input-area-side front end portion 7D of the operation unit 7. In other words, a dimension W1 from the scanner unit 5 to the touchscreen-side front end portion 7C is greater in a horizontal direction, e.g., a front-rear direction, than a dimension W2 from the scanner unit 5 to the input-area-side front end portion 7D.

The "touchscreen-side front end portion 7C" refers to a front end portion of the operation unit 7, which is proximate to front ends of the upper cover 9A and the lower cover 9 and in front of the touchscreen 7A rather than the input area 7B. The "input-area-side front end portion 7D" refers to a front end portion of the operation unit 7, which is proximate to front ends of the upper cover 9A and the lower cover 9 and in front of the input area 7B rather than the touchscreen 7A.

As illustrated in FIGS. 1 and 5, the sheet ejection tray 3B has left and right recessed portions 3D recessed downward. As illustrated in FIG. 4, when projected on the imaginary horizontal surface, a part of the right recessed portion 3D is disposed further in the front direction than the operation unit 7.

In FIG. 4, the right recessed portion 3D is disposed further in the front direction than an outer end of the operation unit 7.

In other words, the dimension W2 is smaller than the dimension W1. When looking at the operation unit 7 from above, a user can visually check the position of the sheet ejection tray 3 at the right recessed portion 3D partially exposed from the outer end of the operation unit 7.

Figure 7:
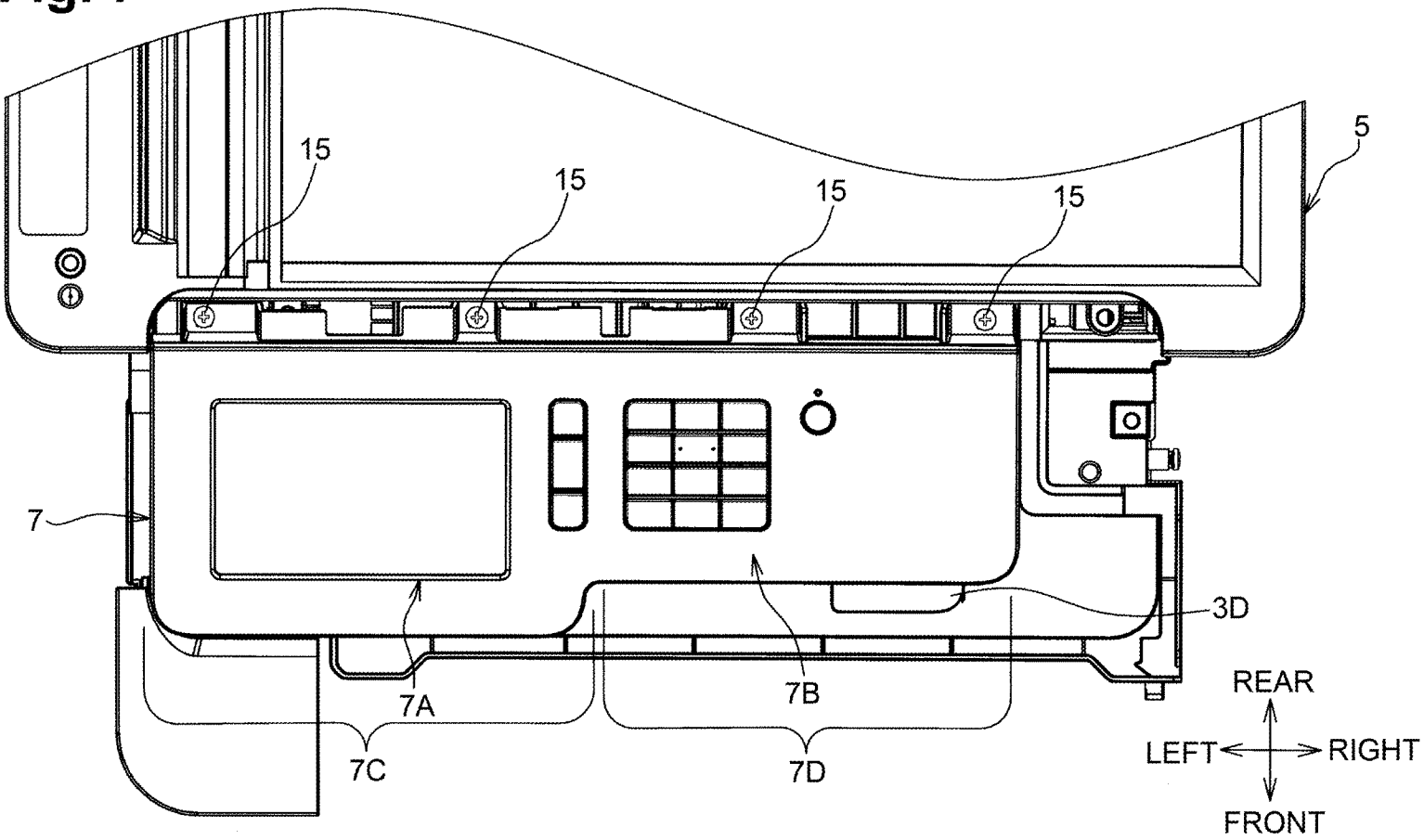
FIG. 7 is a top view of an operation unit.
Figure 8:
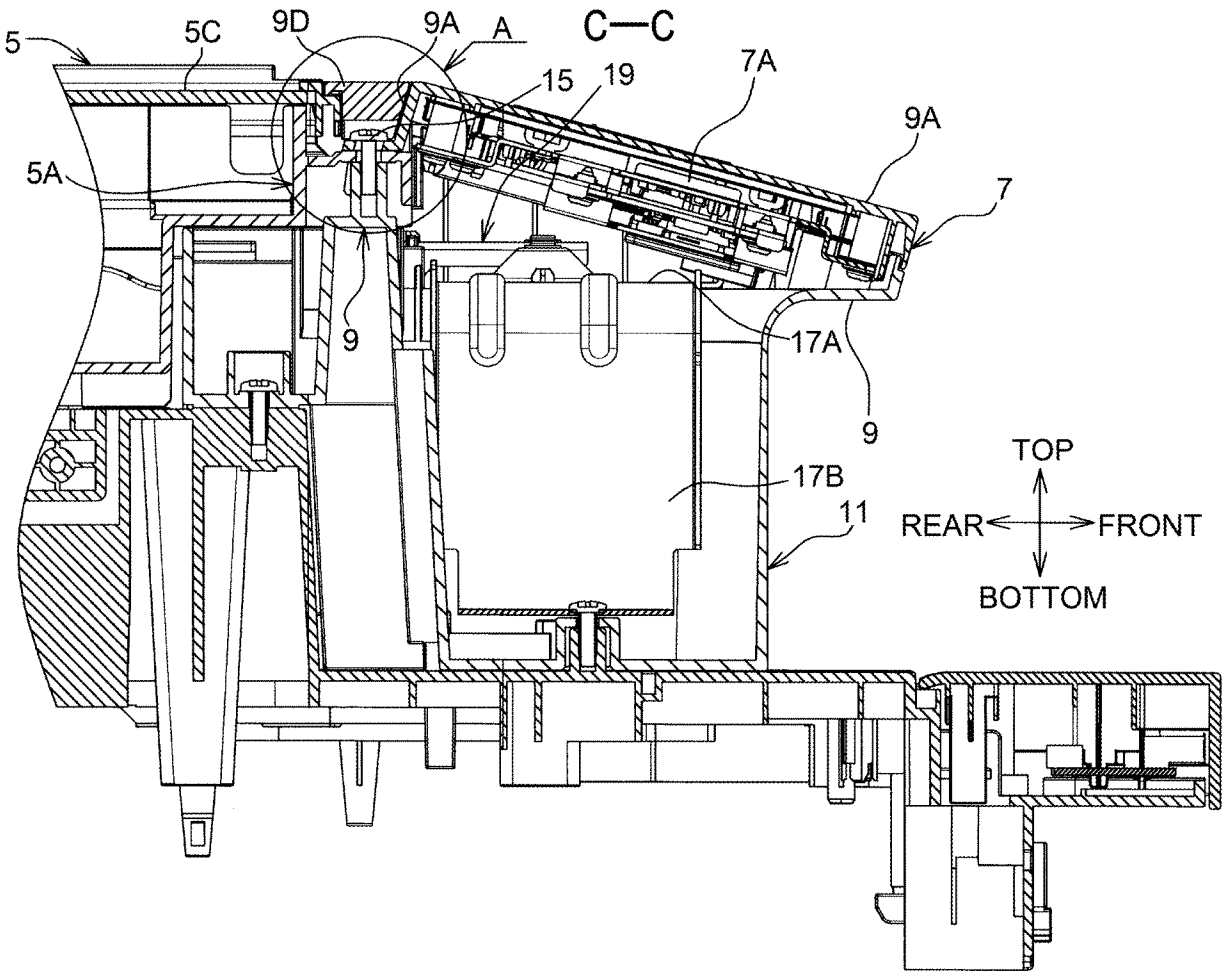
FIG. 8 is a cross sectional view taken along the line C-C of FIG. 4.

As illustrated in FIG. 7, the operation unit 7 (including the upper cover 9A and the lower cover 9) is fixed to the front side of the scanner unit 5 with plural screws 15. Specifically, as illustrated in FIG. 8, each screw 15 passes through the upper cover 9A, the lower cover 9, and the base portion 5A.

Figure 9:
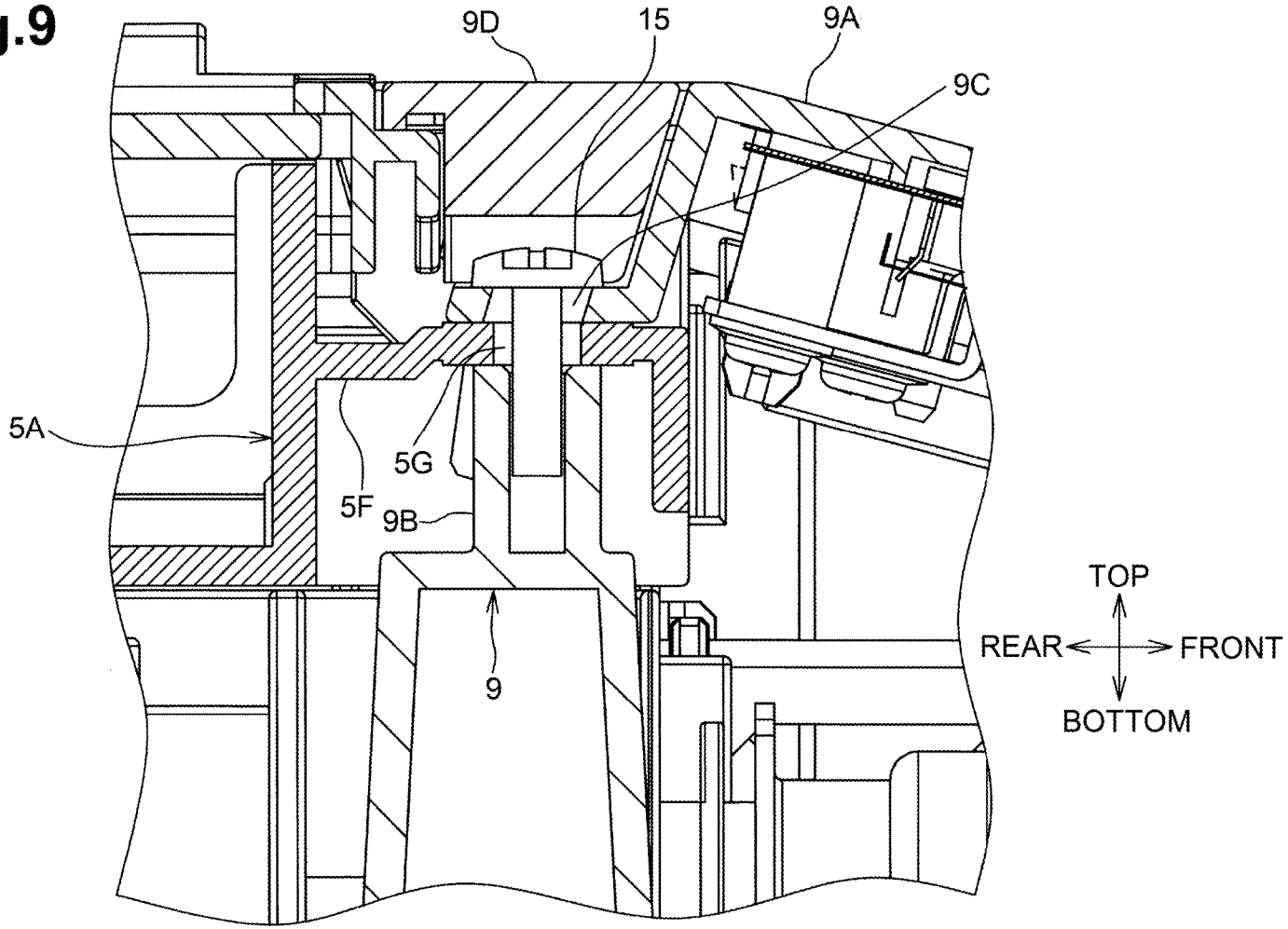
FIG. 9 is an enlarged view of a portion A in FIG. 8.

As illustrated in FIG. 9, the lower cover 9 includes a cylindrical portion 9B engageable with a screw 15. Although not illustrated, there are plural cylindrical portions 9B corresponding to individual screws 15. The upper cover 9A has a screw hole 9C through which a screw 15 passes. Although not illustrated, the upper cover 9A has plural screw holes 9C corresponding to the individual screws 15. A stay portion 5F of the base portion 5A has a screw hole 5G through which a screw 15 passes. Although not illustrated, the stay portion 5F has plural screw holes 5G corresponding to the individual screws 15.

At least in each position where a screw 15 is inserted, the lower cover 9, the stay portion 5F (of the base portion 5A), and the upper cover 9A vertically overlap one another in this order from the bottom, such that a corresponding cylindrical portion 9B, screw hole 5G, and screw hole 9C overlap one another.

Each screw 15 passes through the screw holes 5G and 9C from above, and is screwed into a hole of the cylindrical portion 9B. It is noted that each screw 15 of the embodiment is a tapping screw.

Thus, each screw 15 is tightened into a corresponding cylindrical portion 9B, while an external thread of each screw 15 digs an inner circumferential surface of the cylindrical portion 9B, forming an internal thread in the inner circumferential surface. In this manner, each screw 15 is tightened in the cylindrical portion 9B with the upper cover 9A and the lower cover 9 sandwiching the stay portion 5F, and thus the operation unit 7 is fixed to the base portion 5A.

In other words, the cylindrical portions 9B, the screw holes 5G and 9C, and the screws 15 constitute a fixing portion for fixing the lower cover 9 and the upper cover 9A to the front side of the scanner unit 5. Upper portions of the screws 15 are covered with a lid member 9D.

As illustrated in FIG. 7, when projected onto an imaginary horizontal surface, the touchscreen 7A is located to the front of at least one of the screws 15 in the front-rear direction.

In other words, the "imaginary horizontal surface" corresponds to a drawing sheet surface of FIG. 7. In FIG. 7, the touchscreen 7A is located to the front of the second screw 15 from the left.

Figure 10:
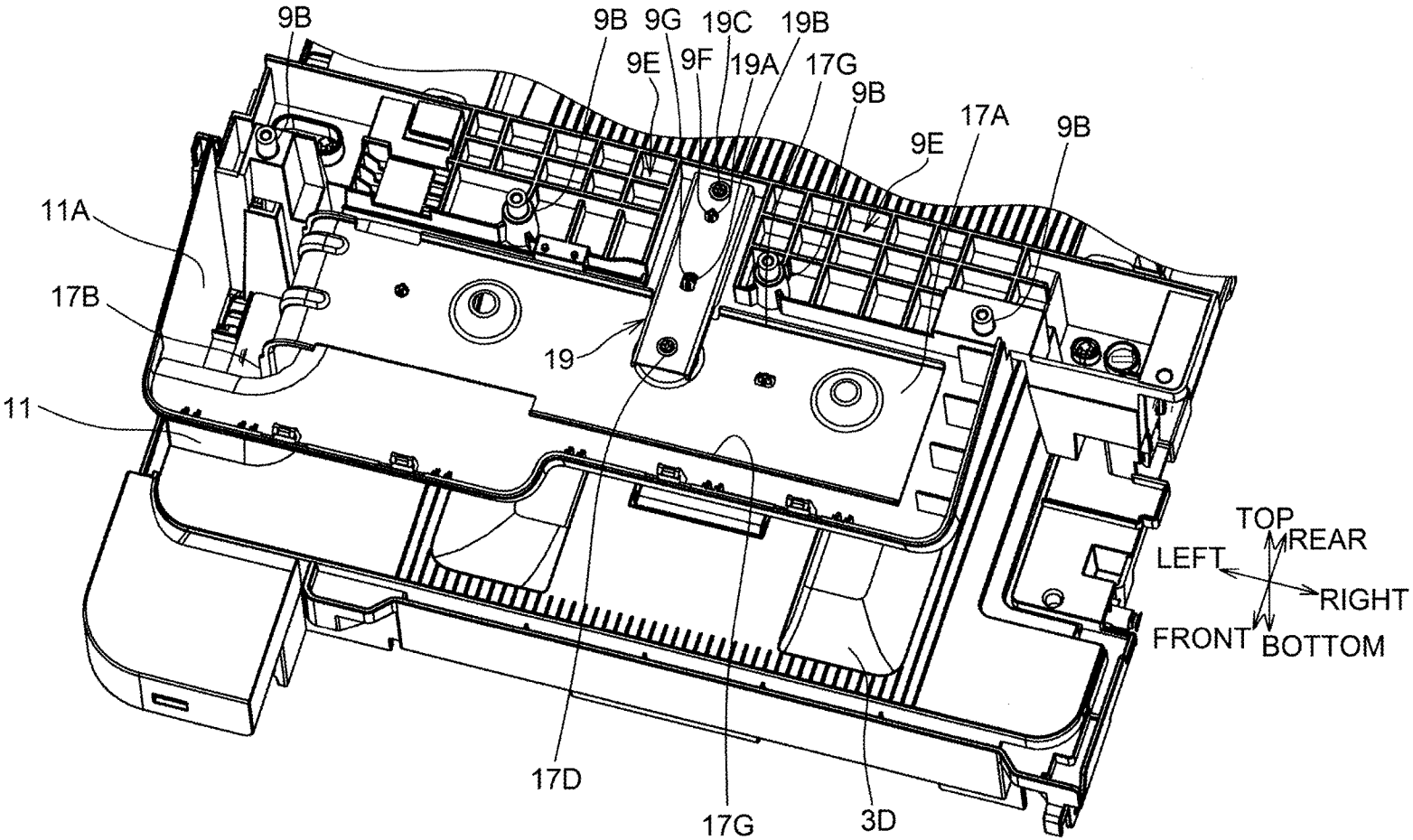
FIG. 10 is a perspective view of a first reinforcing member, a second reinforcing member, and a third reinforcing member being assembled.

As illustrated in FIGS. 5 and 10, a first reinforcing member 17A is located between the upper cover 9A and the lower cover 9. The first reinforcing member 17A is made of metal. The first reinforcing member 17A is fixed to the lower cover 9 and is shaped like a strip extending substantially horizontally in the left-right direction.

Figure 11:
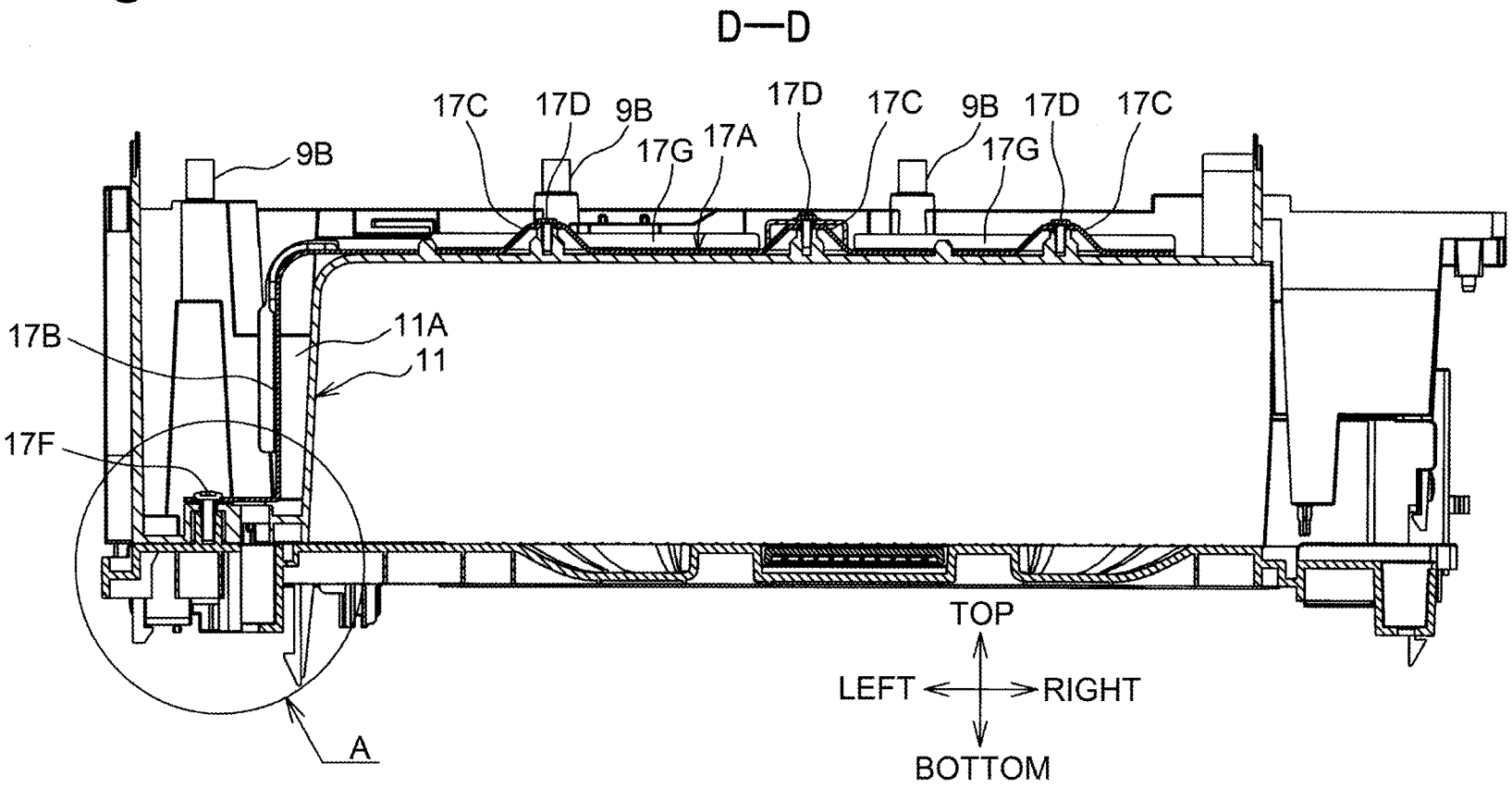
FIG. 11 is a cross sectional view taken along the line D-D of FIG. 4.

The first reinforcing member 17A has wall portions 17G at front and rear ends of the first reinforcing member 17A. The wall portions 17G are bent in the vertical direction. As illustrated in FIG. 11, the first reinforcing member 17A has protrusions 17C protruding upward. The protrusions 17C are located at positions where the first reinforcing member 17A is fixed to the lower cover 9.

The first reinforcing member 17A and the lower cover 9 are fixed with screws 17D each passing through the top of a corresponding protrusion 17C and reaching the lower cover 9. The support portion 11 has a space 11A inside it. A second reinforcing member 17B is located in the space 11A. The second reinforcing member 17B is made of metal.

The second reinforcing member 17B extends in the vertical direction. The upper end of the second reinforcing member 17B is integral with the first reinforcing member 17A. The embodiment shows that the first reinforcing member 17A and the second reinforcing member 17B constitute a single piece as substantially an L-shaped reinforcing member, which is made out of a single metal plate by sheet-metal stamping.

Figure 12:
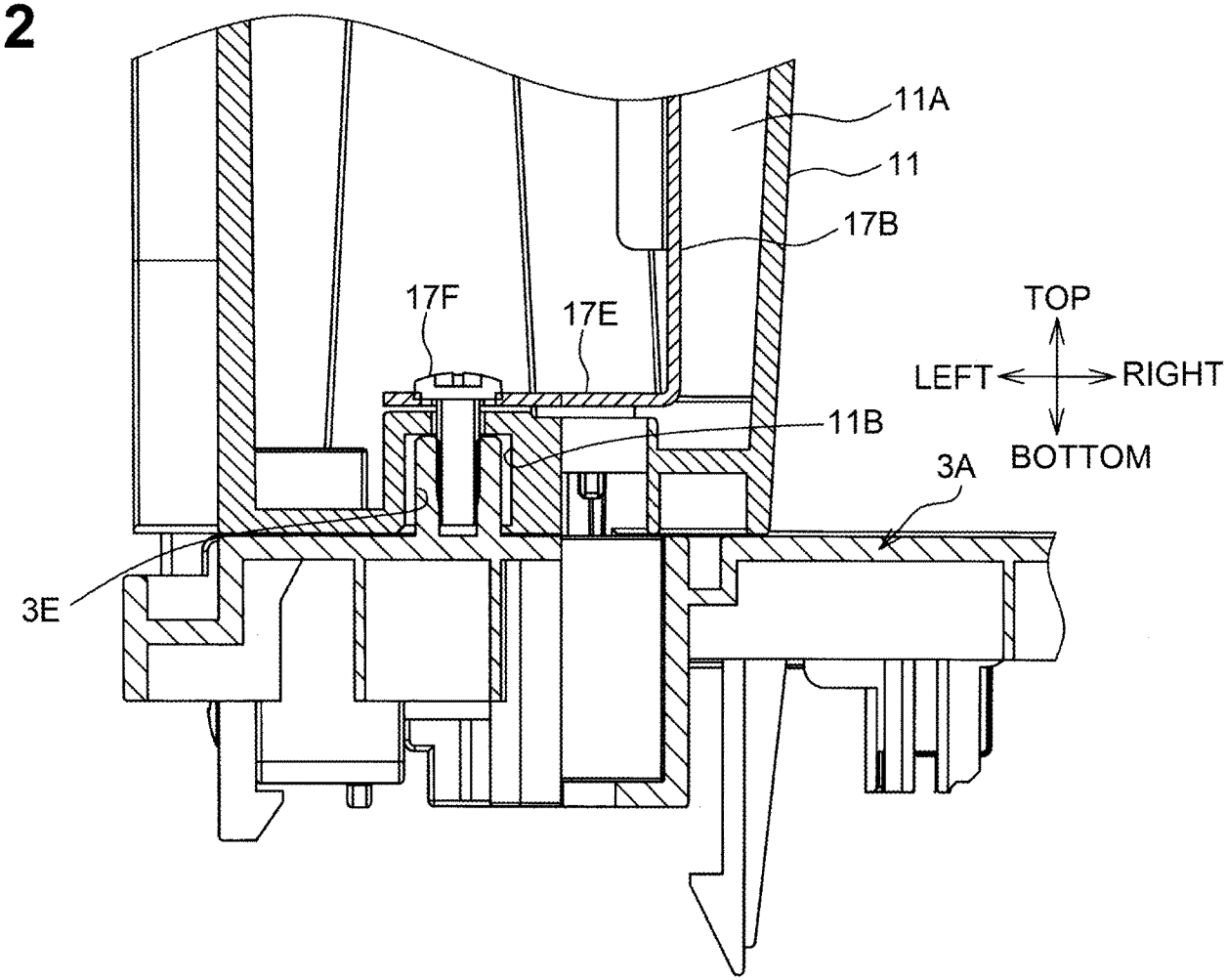
FIG. 12 is an enlarged view of a portion A in FIG. 11.

As illustrated in FIG. 12, the lower end portion of the second reinforcing member 17B is fixed to the lower end portion of the support portion 11. Specifically, the lower end portion of the second reinforcing member 17B of the embodiment includes an attaching portion 17E. The attaching portion 17E is fixed to the lower end portion of the support portion 11 with a screw 17F.

The lower end portion of the support portion 11 includes a recessed portion 11B into which a protrusion 3E is engaged. The housing 3A includes the protrusion 3E. The screw 17F passes through the recessed portion 11B and is tightened into the protrusion 3E. The screw 17F fixes the attaching portion 17E to the lower end portion of the support portion 11 and the lower end portion of the support portion 11 to the housing 3A.

As illustrated in FIG. 10, a third reinforcing member 19 is disposed in a central portion of the lower cover 9 in the left-right direction. The third reinforcing member 19 is made of metal. The third reinforcing member 19 is shaped like a strip. The third reinforcing member 19 is fixed at one end to the first reinforcing member 17A and extends beyond the cylindrical portion 9B toward the scanner unit 5, that is, toward the rear. The tubular portions 9B partially constitute the fixing portion.

The "central portion of the lower cover 9 in the left-right direction" refers to, for example, in FIG. 11, a middle part of three substantially equal parts into which an area of the lower cover 9, which extends from a right end of the support portion 11 to a right end of the lower cover 9, is divided. The third reinforcing member 19 is fixed with the first reinforcing member 17A to the lower cover 9 with a screw 17D.

The third reinforcing member 19 extends toward the rear from the first reinforcing member 17A and has left and right ends bent in the vertical direction, e.g., downward, and is shaped like a square C in cross section.

As illustrated in FIG. 10, the rear portion of the third reinforcing member 19 is fixed to an extension portion 9E. The embodiment shows the rear portion of the third reinforcing member 19 is fixed to the extension portion 9E with a screw 19C. In FIG. 10, the extension portion 9E corresponds to a lattice-like reinforcing wall of the lower cover 9.

As illustrated in FIG. 5, the extension portion 9E is a part of the lower cover 9, which is located below the base portion 5A and extends toward the scanner unit 5 more than the tubular portion 9B. The tubular portions 9B partially constitute the fixing portion.

As illustrated in FIG. 6, the lower cover 9 including the extension portion 9E includes cylindrical boss portions 9H, 9J into which the screws 17D, 19C are inserted. The lower cover 9 including the extension portion 9E also includes protrusions 9F, 9G.

As illustrated in FIG. 10, the protrusions 9F, 9G are engaged in through holes 19A, 19B, respectively, formed in the third reinforcing member 19. The protrusion 9F positions the third reinforcing member 19 in the front-rear direction. The protrusion 9G positions the third reinforcing member 19 in the left-right direction.

In the image forming apparatus 1 of the embodiment, the support portion 11 and the screws 15 partially constituting the fixing portion are configured to receive a downward load acting on the touchscreen 7A, via the lower cover 9.

The support portion 11, which is disposed below the touchscreen 7A, can reduce deformation at a portion of the operation unit 7 including the touchscreen 7A when the touchscreen 7A is subjected to the load.

The embodiment shows that, when projected onto the imaginary horizontal surface, the touchscreen 7A is located to the front of any of the screws 15 in the front-rear direction. It is noted that, when projected onto the imaginary horizontal surface, any of the screws 15 refers to the second screw 15 from the left in FIG. 7.

Thus, the lower cover 9 is fixed to the scanner unit 5 in proximity to the touchscreen 7A, which can prevent the portion of the operation unit 7 including the touchscreen 7A from greatly becoming deformed.

The fixing portion is comprised of the screws 15, and the screw holes 5G, 9C into which the screws 15 are inserted. The screw holes 5G, 9C are communicated with the hole of the cylindrical portion 9B, which is open upward. This facilitates tightening of screws 15 from above.

The embodiment shows the lower cover 9 is made of resin, and the first reinforcing member 17A, which is fixed to the lower cover 9 and extends horizontally, is made of metal. This structure reduces damage to the lower cover 9 due to a load acting on the lower cover 9.

The embodiment shows the support portion 11 is integral with the lower cover 9 and is made of resin. The support portion 11 has a space inside it. The second reinforcing member 17B is integral with the first reinforcing member 17A, and extends vertically. The second reinforcing member 17B is fixed to the lower end portion of the support portion 11. The first and second reinforcing members 17A and 17B receives a load acting on the operation unit 7 before the lower cover 9. This reliably reduces a load acting on the lower cover 9 and the support portion 11.

The embodiment shows the third reinforcing member 19 is fixed at one end to the first reinforcing member 17A and extends beyond the fixing portion including the screws 15 toward the scanner unit 5.

Thus, in addition to the support portion 11 and the fixing portion including the screws 15, the base portion 5A can receive a downward load acting on the operation unit 7, via the third reinforcing member 19. Thus, this structure can prevent the portion of the operation unit 7 including the touchscreen 7A from greatly becoming deformed.

The embodiment shows the lower cover 9 includes the extension portion 9E, which is located below the base portion 5A and extends toward the scanner unit 5 more than the fixing portion including the screws 15.

Via the extension portion 9E, the base portion 5A can receive a downward load acting on the operation unit 7 as well as the support portion 11 and the fixing portion including the screws 15. Thus, this structure can prevent the portion of the operation unit 7 including the touchscreen 7A from greatly becoming deformed.

The embodiment shows the third reinforcing member 19 is fixed at the other end to the extension portion 9E. Thus, this structure can prevent the portion of the operation unit 7 including the touchscreen 7A from greatly becoming deformed.

The embodiment shows the input area 7B is located at a position spaced from the touchscreen 7A in the sheet width direction orthogonal to the sheet ejection direction. The lower cover 9 covers the bottom side of the input area 7B and receives a downward load acting on the input area 7B.

The embodiment shows the front end portion 7C of the operation unit 7, which is in the front of the touchscreen 7A, is disposed further in the front direction than the front end portion 7D.

This structure enables the user to visually check a sheet ejected onto the sheet ejection tray 3B with relative ease. Thus, the user can take the ejected sheet out of the sheet ejection tray 3B with relative ease.

The embodiment shows the sheet ejection tray 3B has recessed portions 3D recessed downward. When projected on the imaginary horizontal surface, a part of the right recessed portion 3D is disposed further in the front direction than the lower cover 9 or the operation unit 7.

Thus, the user can visually check the position of the sheet ejection tray 3 at the right recessed portion 3D partially exposed from the outer end of the operation unit 7, and easily take a sheet out of the sheet ejection tray 3B.

The above embodiment shows that the touchscreen 7A is located to the front of the fixing portion including the screws 15 in the front-rear direction. The disclosure is not limited to the above embodiment. For example, the rear end of the touchscreen 7A may overlap the fixing portion such as the screws 15 in the vertical direction.

The above embodiment shows the first, second, and third reinforcing members 17A, 17B, 19. The disclosure is not limited to the above embodiment. At least one of the first, second, and third reinforcing members 17A, 17B, 19 may be omitted.

The above embodiment shows that the first and second reinforcing members 17A, 17B constitute a single piece made out of a single metal plate. The disclosure is not limited to the above embodiment.

For example, the first reinforcing member 17A and the second reinforcing member 17B may be formed separately. In this case, the first reinforcing member 17A and the second reinforcing member 17B may be coupled to each other with a mechanical coupler such as a screw. Alternatively, the first reinforcing member 17A and the second reinforcing member 17B each may be fixed to the lower cover 9.

The above embodiment shows that the second reinforcing member 17B is fixed to the lower end portion of the support portion 11. The disclosure is not limited to the above embodiment. For example, the second reinforcing member 17B may be fixed to a side surface of the support portion 11 or fixed to the housing 3A or the base portion 5A.

The above embodiment shows the extension portion 9E. The disclosure is not limited to the above embodiment. The extension portion 9E may be omitted.

The above embodiment shows that the extension portion 9E is located below the base portion 5A. The disclosure is not limited to the above embodiment. The extension portion 9E and the base portion 5A may be fixedly coupled with a mechanical coupler such as a screw.

The above embodiment shows that the third reinforcing member 19 is fixed to the extension portion 9E. The disclosure is not limited to the above embodiment. The third reinforcing member 19 may not be fixed to the extension portion 9E.

The above embodiment shows that the front end portion 7C of the operation unit 7, which is in the front of the touchscreen 7A, is disposed further in the front direction than the front end portion 7D. The disclosure is not limited to the above embodiment. The end portion 7C and the end portion 7D may be aligned with each other.

The above embodiment shows that, when projected on the imaginary horizontal surface, a part of the right recessed portion 3D is disposed further in the front direction than the lower cover 9 or the operation unit 7. The disclosure is not limited to the above embodiment. The recessed portions 3D may be omitted.

While the features herein have been described in connection with various example structures and illustrative aspects, it will be understood by those skilled in the art that other variations and modifications of the structures and aspects described above may be made without departing from the scope of the disclosure described herein. Other structures and aspects will be apparent to those skilled in the art from a consideration of the specification or practice of the features disclosed herein. It is intended that the specification and the described examples only are illustrative with the true scope of the disclosure being defined by the following claims.

What is claimed is:

1. An image forming apparatus comprising:

a printer unit configured to form an image on a sheet, the printer unit including a sheet ejection tray, the sheet ejection tray being located on an upper surface of the printer unit and configured to receive the sheet ejected from the printer unit;

a scanner unit spaced above the sheet ejection tray of the printer unit in a vertical direction, the scanner unit including a base portion, the base portion including a document receiving portion configured to receive a document to be scanned;

an operation unit disposed at a front end portion of the scanner unit, the front end portion being located toward a downstream side of the sheet ejection tray in a sheet ejection direction in which the sheet is ejected from the printer unit toward the sheet ejection tray, the operation unit including a touchscreen;

a cover covering a bottom side of the touchscreen in the vertical direction; and a fixing portion fixing the cover to the front end portion of the scanner unit, wherein the cover includes a support portion that, when projected on an imaginary horizontal surface, overlaps a part of the touchscreen, the support portion being shaped like a box extending in the vertical direction and being coupled to a portion of the upper surface of the printer unit adjacent to the sheet ejection tray.

2. The image forming apparatus according to claim 1, wherein the touchscreen, when projected on the imaginary horizontal surface, is located further in the sheet ejection direction than the fixing portion.

3. The image forming apparatus according to claim 1, wherein the fixing portion includes a screw and a screw hole in which the screw is engaged, the screw hole being open upward in the vertical direction.

4. The image forming apparatus according to claim 1, further comprising a first reinforcing member made of metal, wherein the cover is made of resin, and wherein the first reinforcing member is fixed to the cover and extends in a sheet width direction orthogonal to the sheet ejection direction.

5. The image forming apparatus according to claim 4, further comprising a second reinforcing member made of metal, wherein the support portion is made of resin, and wherein the second reinforcing member extends in the vertical direction inside the support portion and is fixed to a lower end of the support portion, the second reinforcing member being integral with the first reinforcing member.

6. The image forming apparatus according to claim 4, further comprising a second reinforcing member fixed at one end to the first reinforcing member and extending in a direction beyond the fixing portion toward the scanner unit.

7. The image forming apparatus according to claim 6, wherein the cover includes an extension portion located below the base portion in the vertical direction, and wherein the second reinforcing member is fixed at another end to the extension portion.

8. The image forming apparatus according to claim 1, wherein the cover includes an extension portion located below the base portion in the vertical direction.

9. The image forming apparatus according to claim 1, wherein the operation unit includes an input area spaced from the touchscreen in a sheet width direction orthogonal to the sheet ejection direction, wherein the cover covers a bottom side of the input area, and wherein the cover has a front end portion located toward the downstream side of the sheet ejection tray in the sheet ejection direction, the front end portion including a first end portion in front of the touchscreen and a second end portion in front of the input area, the first end portion being located further in the sheet ejection direction than the second end portion.

10. The image forming apparatus according to claim 1, wherein the sheet ejection tray has a recessed portion that, when projected on the imaginary horizontal surface, has a part disposed further in the sheet ejection direction than the cover.

11. The image forming apparatus according to claim 1, wherein the scanner unit is configured to input a document from the document receiving portion for scanning in a direction orthogonal to the sheet ejection direction in which the sheet is ejected from the printer unit.

12. The image forming apparatus according to claim 1, wherein, in the vertical direction, the entire front end portion overlaps the downstream side of the sheet ejection tray.

13. An image forming apparatus comprising:

a printer unit configured to form an image on a sheet, the printer unit including a sheet ejection tray, the sheet ejection tray being located on an upper surface of the printer unit and configured to receive the sheet ejected from the printer unit;

a scanner unit spaced above the sheet ejection tray of the printer unit in a vertical direction, the scanner unit including a base portion, the base portion including a document receiving portion configured to receive a document to be scanned;

an operation unit disposed at a front end portion of the scanner unit, the front end portion being located toward a downstream end of the sheet ejection tray in a sheet ejection direction in which the sheet is ejected from the printer unit toward the sheet ejection tray, the operation unit including a touchscreen;

a cover covering a bottom side of the touchscreen in the vertical direction; and a fixing portion fixing the cover to the front end portion of the scanner unit, wherein the cover includes a support portion that, when projected on an imaginary horizontal surface, overlaps a part of the touchscreen, the support portion being shaped like a box extending in the vertical direction and being coupled to a portion of the upper surface of the printer unit adjacent to the sheet ejection tray, wherein, in the vertical direction, the operation unit overlaps the downstream end of the sheet ejection tray.

14. The image forming apparatus according to claim 13, wherein the touchscreen, when projected on the imaginary horizontal surface, is located further in the sheet ejection direction than the fixing portion.

15. The image forming apparatus according to claim 13, wherein the fixing portion includes a screw and a screw hole in which the screw is engaged, the screw hole being open upward in the vertical direction.

16. The image forming apparatus according to claim 13, further comprising a first reinforcing member made of metal, wherein the cover is made of resin, and wherein the first reinforcing member is fixed to the cover and extends in a sheet width direction orthogonal to the sheet ejection direction.

17. The image forming apparatus according to claim 16, further comprising a second reinforcing member fixed at one end to the first reinforcing member and extending in a direction beyond the fixing portion toward the scanner unit.

18. The image forming apparatus according to claim 13, wherein the cover includes an extension portion located below the base portion in the vertical direction.

19. The image forming apparatus according to claim 13, wherein the operation unit includes an input area spaced from the touchscreen in a sheet width direction orthogonal to the sheet ejection direction, wherein the cover covers a bottom side of the input area, and wherein the cover has a front end portion located toward the downstream end of the sheet ejection tray in the sheet ejection direction, the front end portion including a first end portion in front of the touchscreen and a second end portion in front of the input area, the first end portion being located further in the sheet ejection direction than the second end portion.

20. The image forming apparatus according to claim 13, wherein the sheet ejection tray has a recessed portion that, when projected on the imaginary horizontal surface, has a part disposed further in the sheet ejection direction than the cover.

* * * * *